US005732585A

United States Patent [19]

Haushahn et al.

[11] Patent Number: 5,732,585

[45] Date of Patent: Mar. 31, 1998

[54] PORTABLE HAND OPERATED SHEET METAL TOOL

[75] Inventors: Steven L. Haushahn, Bismarck; Richard K. Varnell, Malvern, both of Ark.

[73] Assignee: Malvern Tools Inc., Malvern, Ark.

[21] Appl. No.: 746,868

[22] Filed: Nov. 18, 1996

[51] Int. Cl.[6] ..... B21D 9/08; B21D 7/02

[52] U.S. Cl. ..... 72/210; 72/214

[58] Field of Search ..... 72/210, 211, 214, 72/179, 182, 325, 76; 30/371, 373, 280, 289, 294; 83/886, 875; 29/243.58

[56] References Cited

U.S. PATENT DOCUMENTS

| | | | |
|---|---|---|---|
| 2,660,909 | 12/1953 | Morse et al. | 72/211 |
| 2,982,331 | 5/1961 | Bonner | 72/210 |
| 4,397,089 | 8/1983 | Pease | 30/373 |

*Primary Examiner*—Lowell A. Larson
*Assistant Examiner*—Rodney Butler
*Attorney, Agent, or Firm*—Stephen D. Carver

[57] ABSTRACT

A hand held, sheet metal forming tool for siding installation. A main frame comprises a base and an integral, semi-circular, ambidextrous handle. The operator simply pushes the tool along siding to bead or form it by grasping either end of the handle with either hand. A pair of spaced apart, cooperating press rollers press against opposite sheet sides. A deforming pattern defined in the upper roller and a mating deforming pattern that is slightly offset in the lower roller captivate and form siding sandwiched therebetween. An offset admission throat is formed at each end of the guide channel to ease sheet insertion. Siding entering either throat is captivated within a bifurcated guide channel longitudinally coextensive with the frame that preserves alignment. The guide channel comprises intersecting vertical and horizontal guide slots. As the tool moves, the upturned siding edge slides within a vertical guide slot, maintaining spacing and alignment. Sheet material is confined within a horizontal slot generally parallel with the axis of roller rotation that constrains sheet shifting during pressing. At each side of the bifurcation point between separate horizontal guide slot portions, an angled wedge forces metal admission into the adjacent guide slot portion. Each roller is mounted on an axle that extends from a subframe and penetrates the frame. Subframe spacing from the frame controls press wheel offset, which may be selectively adjusted by a threaded knob.

11 Claims, 8 Drawing Sheets

PORTABLE HAND OPERATED SHEET METAL TOOL

BACKGROUND OF THE INVENTION

I. Field of the Invention

This invention relates generally to portable, sheet metal forming tools. More specifically, the invention relates to hand tools for beading or groove-reinforcing sheet metal, including aluminum and steel siding. Known prior art may be found in U.S. Classes 29, 30 and 81 and the relevant subclasses thereunder.

II. Description of the Prior Art

As will be recognized by those skilled in the siding installation trade, the sheet metal must be formed and reinforced prior to installation. Steel and aluminum are most commonly used for siding applications. Metal siding provides a rugged and durable exterior covering for buildings, and numerous well known advantages are realized when siding is installed.

Typically, the raw sheet metal known as "coil stock" is delivered to the job site in rolls fifty feet long and two feet wide. At the job location sections of metal are unwound, and prepared for installation. However, prior to installation the metal siding must be cut, formed, and reinforced by suitable machines. Known machines comprise large, heavy and cumbersome devices that usually must be trailer mounted and hauled to the job site. This custom forming must occur at specific job sites, as the required dimensions and configuration of specific panels are impossible to determine prior to measurement at the site. As a result, the installer must custom bend or form the siding at the job site.

Another problem with the installation of aluminum siding involves its tendency to "ripple" when nails are inserted into it. This effect, often referred to as "oil canning," undesirably disfigures the siding. It can also cause the siding to become misaligned during installation. Thus, the siding must be suitably reinforced prior to installation to enable it to withstand rippling or oil canning.

Further, long sections or strips of siding tend to bend or fold without reinforcement. One reinforcement technique deforms the sheeting or siding at regular intervals by bending it. By the application of pressure bends or grooves through beading, the sheet metal strips or sections are reinforced. Further, professional beading adds an aesthetic dimension to the siding. Some customers prefer different beading patterns than others. It is important that the installer be able to reinforce the metal in a timely, efficient manner. Further, the installer must be able to offer a variety of beading patterns and shapes for both aesthetic and practical reasons.

The only conventional tool for such bending siding presently known is often referred to as a "brake." Conventional brakes are simply elongated stands that clamp a portion of the metal sheet or siding. The brake enables the installer to insert a sheet of siding and then clamp the inserted portion. The installer then bends the sheet along the longitudinal edge of the brake.

Reinforcing bends may be applied in a variety of configurations. The simplest pattern commonly forms a forty-five degree reinforcement angle into the sheet of siding. However, in order to deform the sheet with only one forty-five degree angle, the installer must insert the sheet, bend it and then reinsert it and bend it again. This task can easily become quite time consuming, even if perfectly done the first time. Also, any error in the bending often results in a wasted sheet of siding.

One attempt to alleviate these problems is shown in U.S. Pat. No. 3,808,873. This interesting handheld tool is used in conjunction with the conventional brake to bend the edges of metal sheets and/or siding. While it may permit the installer to make similar bends along a sheet held in a brake, it fails to overcome the time consuming task of inserting and removing and inserting and removing the sheet from the brake.

While applicants are unaware of other prior art directed to the same endeavor as the instant invention, some known prior art is of limited relevance. U.S. Pat. No. 2,434,401 to Farnstrom has a side mounted handle and a pair of cooperating rollers for forming metal. However, the device is adapted to be used primarily with hard sheet metal, such as that found on automobiles.

U.S. Pat. No. 2,808,748 to Bledsoe is similar to Farnstrom. The device shown therein may also be used to "crimp" metal. U.S. Pat. Nos. 837,783, 2,660,909, 2,471,445 and 4,825,676 show similar devices for deforming sheet metal. In general, these devices require the operator to first appropriately place the device on the metal and then crank a handle or other object to move the device along the sheet metal. Thus, these devices typically require both hands of the user to be operated appropriately.

U.S. Pat. No. 5,024,076 shows an interesting device adapted to deform sheet metal. Unlike the above referenced devices, this apparatus only uses one wheel to deform the metal.

All of these handheld tools are adapted to deform a sheet of metal in some fashion with at least one roller. However, all of these tools lack critical alignment and adjustment mechanisms. The lack of such mechanisms makes these tools undesirably difficult to operate.

Other types of metal deforming machines of general relevance are shown in U.S. Pat. Nos. 3,710,607 and 3,932,725. However, these devices are bulky and cumbersome, neither being a handheld tool adapted to be easily transported about a work site. Thus, they are undesirably difficult to operate.

Therefore, it is desirable to provide a portable, handheld tool that enables an installer to quickly and easily bead metal siding. Such a tool would necessarily need to be easily adjustable to accommodate varying sizes of sheets or siding or the like. A guide facilitating consistent alignment during the bending process would also improve the tool.

Further, an ideal tool would permit either left or right-handed operation. Also, since installers often choose to employ various beading patterns, quick coupling, interchangeable roller pairs that produce different patterns would be desirable as well.

Such a tool should also adapt to use with or without a conventional brake upon which to clamp the sheet or siding. Of course, when used with a conventional brake, the tool would obviously diminish the time necessary to deform the sheet of siding since the operator would not need to constantly reposition it.

SUMMARY

The present invention overcomes the above referenced problems associated with known prior art tools. Our portable tool forms sheet metal siding by beading the metal as rollers compress and form the material as the tool is manually drawn along the sheet by the operator.

The tool comprises a main frame with an integral handle. During use, the operator simply grasps the handle and pushes the tool along the sheet or siding to deform it. When so pushed, a pair of spaced apart, cooperating press rollers move about opposite faces of the siding. Resultant roller compression forms grooves or beads that form and reinforce the material.

An upper roller supports the tool while pressing downwardly upon the siding. A deforming pattern defined circumferentially about the upper roller is complementary to a similar pattern formed in the lower roller. The mating deforming pattern in the lower roller is slightly offset from the deforming pattern of the upper roller. Thus, as the two rollers slidably sandwich the siding, it is pressed between them and forcibly custom shaped.

Preferably, the sheet of siding is constantly aligned by a generally L-shaped (in cross section) guide channel defined in the frame. The guide channel means comprises a vertical and a horizontal slot that intersect. As the tool moves over the siding, the conventional upturned siding edge simply slides within the vertical slot. Thus, proper alignment is maintained with respect to the rollers, as the spacing between the guide channel and that portion of the metal being formed is maintained. The guide is lined with an appropriate non-abrasive surface to prevent siding marring. In the preferred embodiment, the guide periodically emits a lubricant to prevent marring.

Each roller is rotatably mounted on a separate axle that axially penetrates the frame. Each roller easily rotates about each axle. Preferably, the rollers are hard plastic so that they do not mar the siding. Also, they preferably quick-connect to simplify removal whenever the operator desires to switch rollers to alter the resultant deformation pattern.

Each axle is slidably displaceable through the frame. A spaced apart subframe anchors the axles. In the preferred embodiment, the subframe spacing is variable. It may be adjusted to accommodate various operational parameters. A knurled, outer knob threadably coupled to a threaded projection permits the operator to adjust the subframe spacing. When the knob is turned clockwise, the spacing decreases; when the knob is turned counterclockwise, the spacing increases. As the spacing changes, the rollers move counter to the subframe movement. In other words, when the subframe moves toward the frame, the rollers move away and vice-versa.

The tool may be used with or without a conventional brake. When used with a brake, the sheet or siding is simply inserted into the brake in the normal fashion and then the tool moves over the clamped sheet. When used without a brake, the sheet may be otherwise supported as the tool moves over the sheet. Other support devices commonly found at construction sites include edges of floors, truck beds, saw horses, etc. After deforming, the sheet or siding may then be quickly installed in the usual manner.

Thus a primary object of this invention is to provide an affordable, lightweight beading tool that rapidly aids in the installation of sheet metal.

A related object is to provide a portable hand tool that forms siding.

Another important object is to provide a portable hand tool of the character described that reinforces planar metal sheets by applying pressure bends.

Yet another object is to provide a hand tool of the character described which can be used at the job site during the application of sheet metal siding that makes the continued use of a bending brake unnecessary.

A further object of this invention is to provide a hand tool of the character described that reduces the "oil canning effect."

Another object is to provide an easily operated, light weight and affordable hand tool for quickly forming metal siding that may be carried about the job site by the installer.

It is a feature of this tool that it quickly and easily interfits with a diverse variety of forming roller pairs so that different sheet metal pressure bends or bead patterns may be made.

Yet another object of this invention is to provide a convenient roller spacing adjustment mechanism that offsets the roller wheels properly while avoiding drive axle binding.

Another basic object of this invention is to provide a quick, field-adjustable, portable hand sheet metal and/or siding tool of the character described that may be used by tradesmen in a wide variety of applications.

Another basic object of this invention is to provide a sheet metal and/or siding tool of the character described that provides suitably aligned reinforcement groves so that adjoining pieces can be appropriately overlapped.

Still another object of this invention is to provide a tool of the character described which enables precision adjustments to the sheet metal and/or siding so that they may be fitted to the soffet and facia at the job site.

Another object of this invention is to save time and effort at the work site during the erection of sheet metal and/or siding by obviating the necessity of continuously inserting and removing the metal and/or siding into and out of a conventional brake.

Another object of this invention is to provide a hand tool of the character described that may be used with plurality of different interchangeable rollers.

Another object of this invention is to minimize brake use to consequently increase worker productivity.

An object of this invention is to provide a tool of the character described that quickly grasps the pre-bent metal and/or siding and slidably guides it through the apparatus without binding, scratching and deforming the metal and/or siding.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
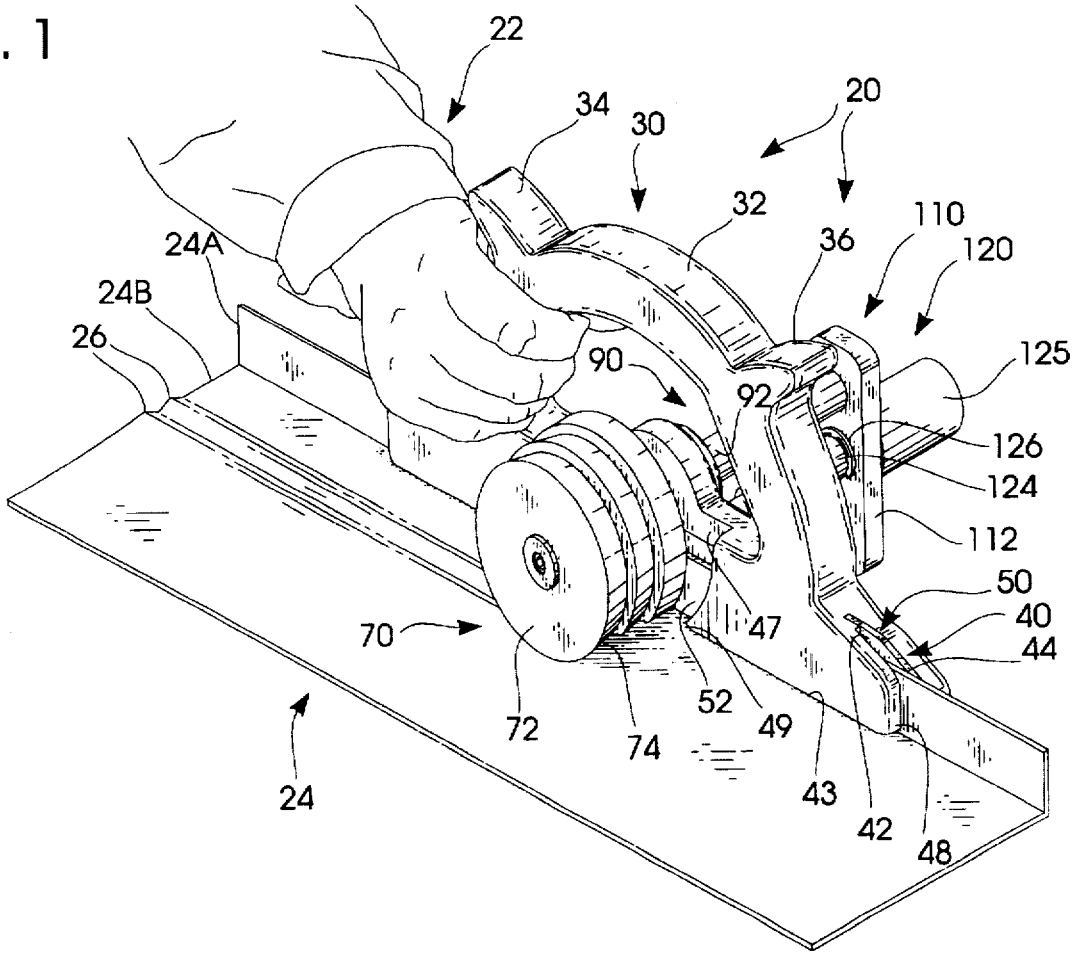
FIG. 1 is an environmental view of a preferred embodiment of our tool, illustrated in use forming a piece of sheet metal.

Referring more specifically to the drawings, my improved portable hand tools 20 or 20A (FIGS. 1 and 2A) form sheet metal and/or aluminum siding. Either tool bends and grooves sheet metal for reinforcing, and may be conveniently carried about by the user. Tools 20 or 20A enable an operator 22 to reinforce planar sheets of material 24 by forming appropriate grooves along the length of the material. The resultant pressure bends or grooves 26 prevent a sheet 24 from flexing or rippling during installation.

Figure 2:
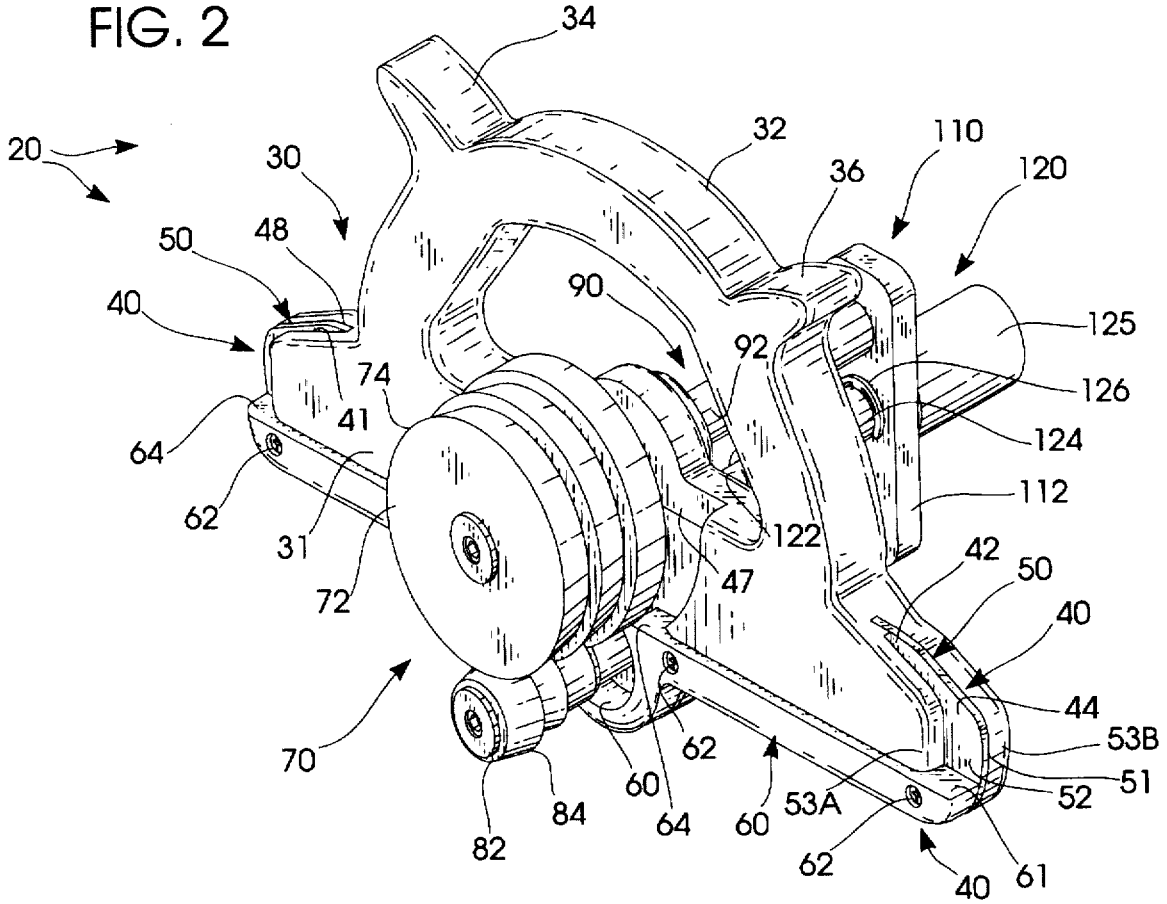
FIG. 2 is a frontal isometric view of a preferred embodiment of the invention.
Figure 2A:
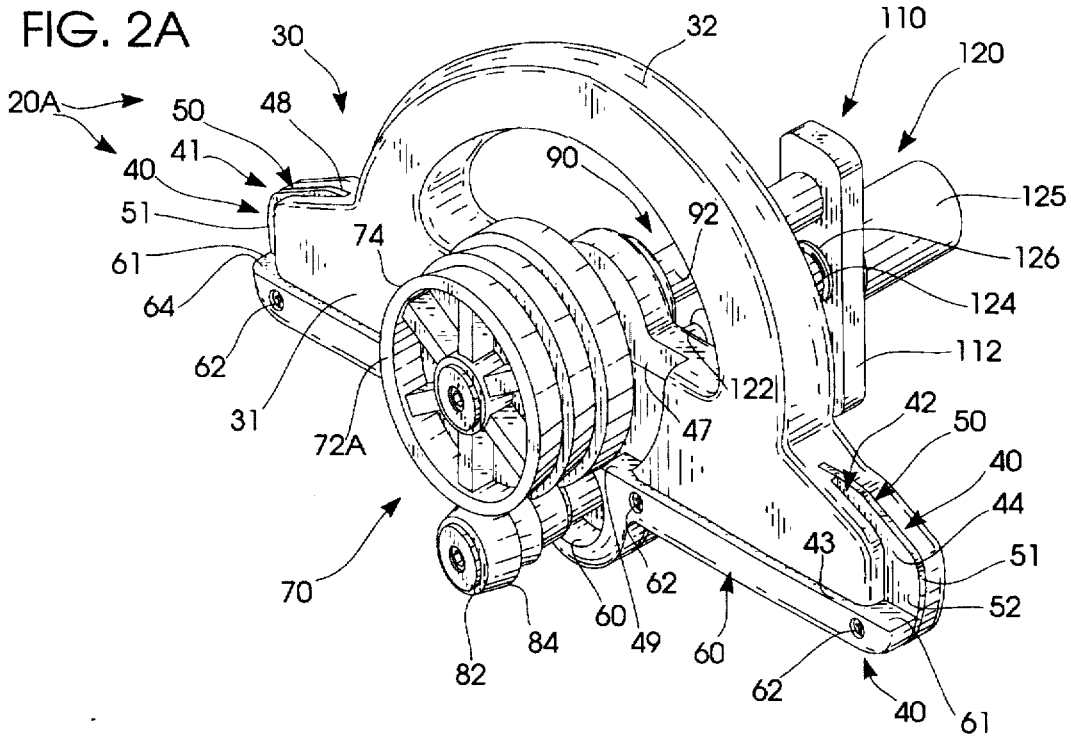
FIG. 2A is a frontal isometric view of an alternative embodiment.

Tool 20, 20A comprises a main frame 30. Frame 30 comprises a base portion 31 and a preferably integral, semi-circular handle 32. The "ambidexterous" handle 32 may be manipulated by either hand of an operator when using tool 20. Preferably spaced apart ears 34, 36 protrude upwardly from handle 32 to enhance operator comfort during use. In FIG. 2A the ears have been omitted, as our most recent experience reveals that some workers prefer not to have them. Either tool 20, 20A may be easily and comfortably used by either left or right-handed operators. Right-handed operation is illustrated in FIG. 1.

Figure 9:
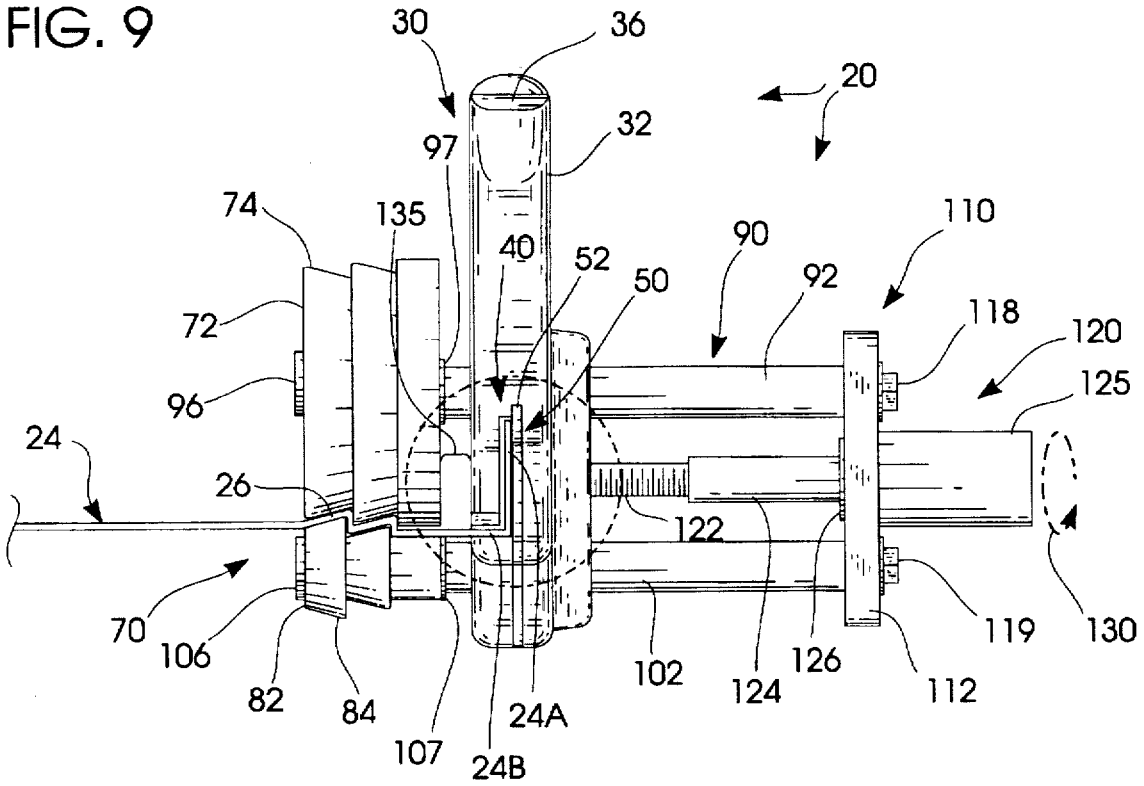
FIG. 9 is a right side elevational view of the tool with a siding section inserted.
Figure 9A:
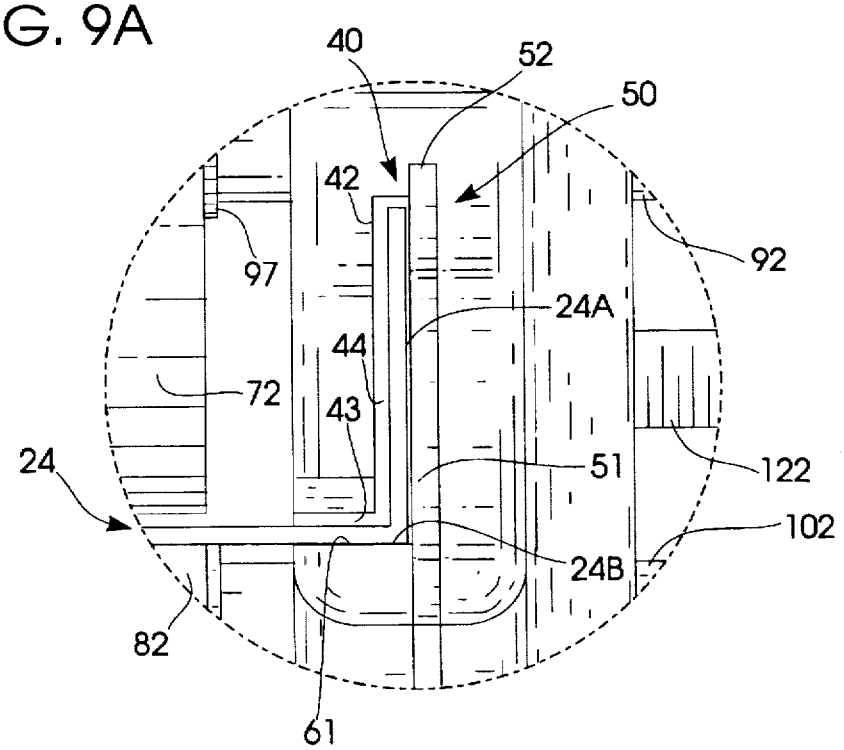
FIG. 9A is an enlarged fragmentary elevational view of that portion of the tool marked with circle 9A in FIG. 9.

The lower half of frame 25 preferably defines an elongated guide channel 40 coextensive with the frame. As best seen in FIGS. 9 and 9A, in cross section the guide channel 40 is generally L-shaped, comprising cooperating, intersecting vertical and horizontal guide slots 43 and 44. Preferably, guide channel 40 is bifurcated adjacent frame midpoint 35; in other words, the guide slots are split in this region, and a circular recess 38 is defined in the frame 25 around midpoint 35. Recess 38 nests the roller wheels when they are drawn inwardly towards the frame 25.

Figure 3:
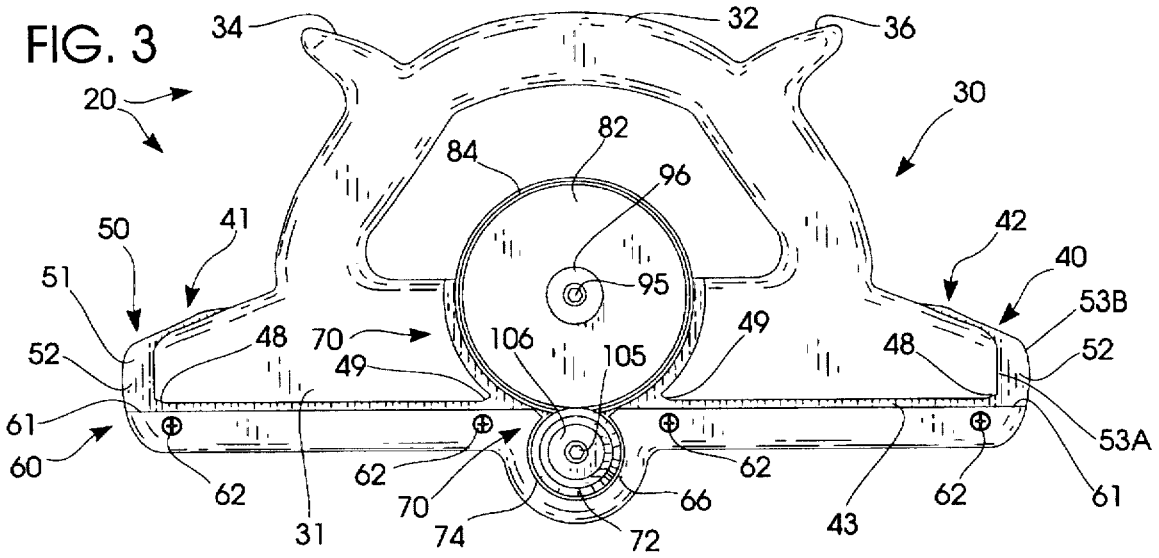
FIG. 3 is a front elevational view.
Figure 4:
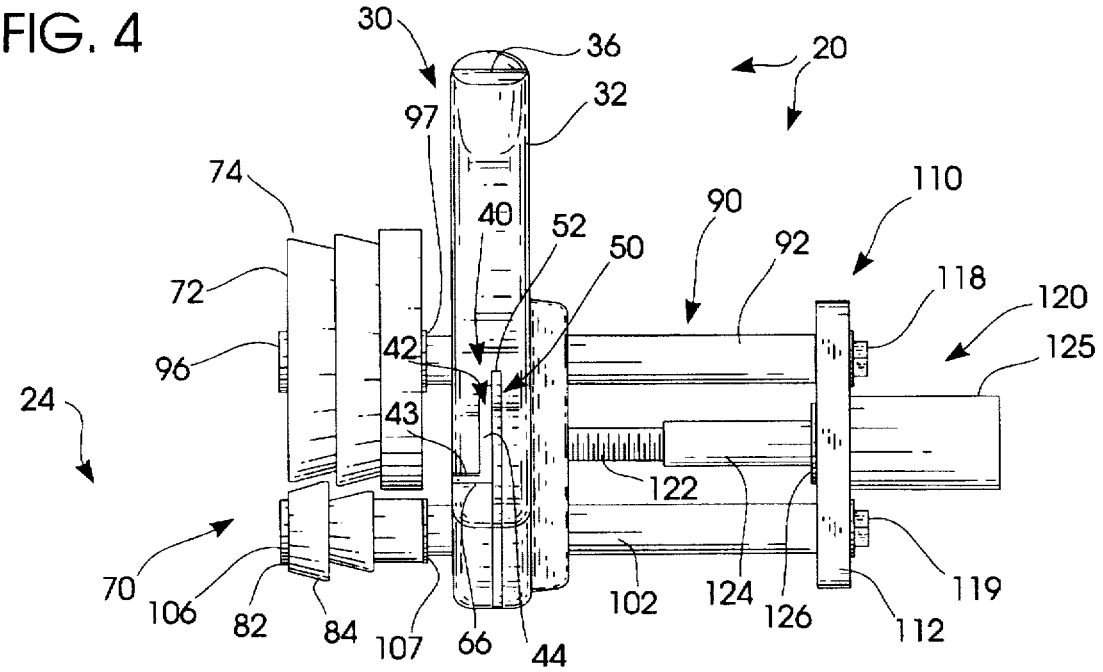
FIG. 4 is a right side elevational view taken generally from the right of FIG. 3, the left side elevational view being a mirror image thereof.
Figure 5:
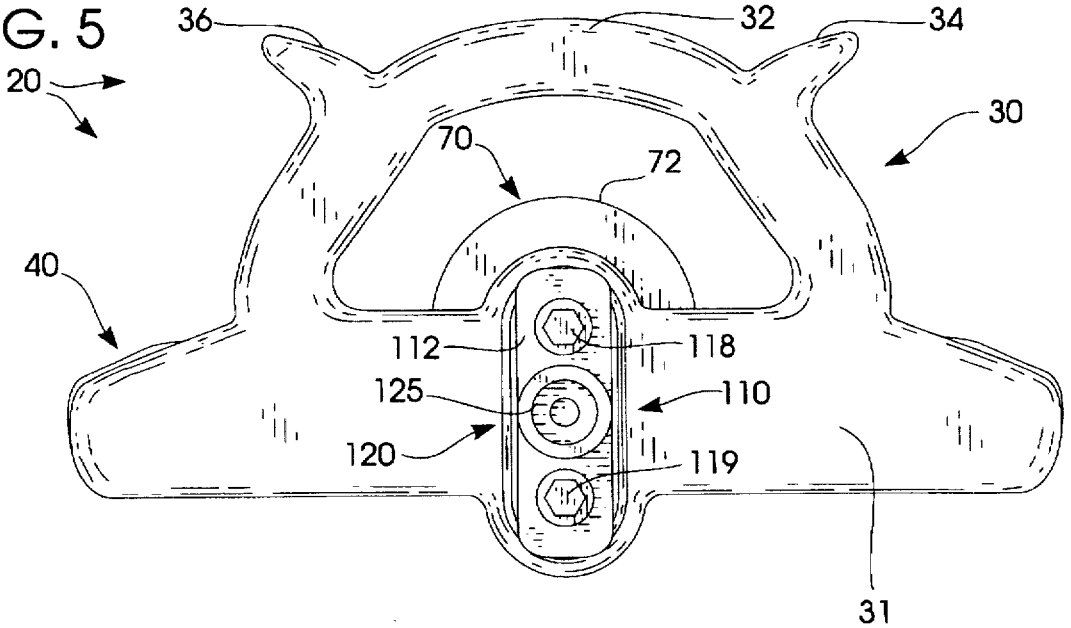
FIG. 5 is a rear elevational view of the invention.
Figure 6:
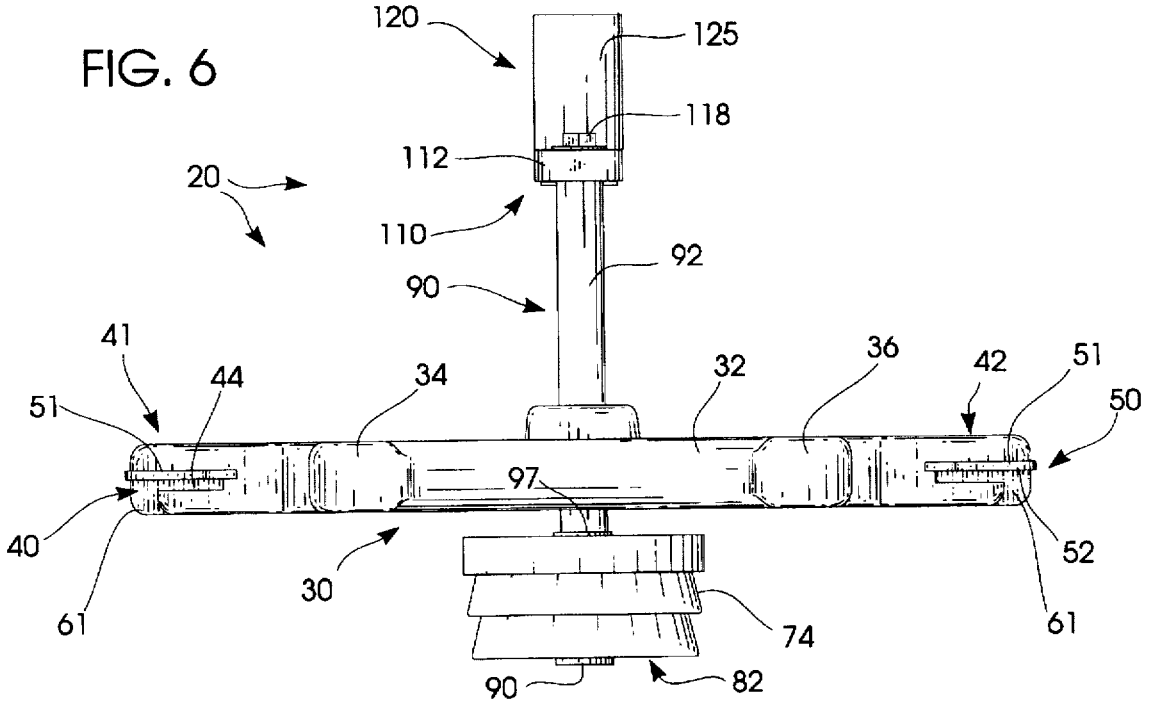
FIG. 6 is a top plan view.
Figure 7:
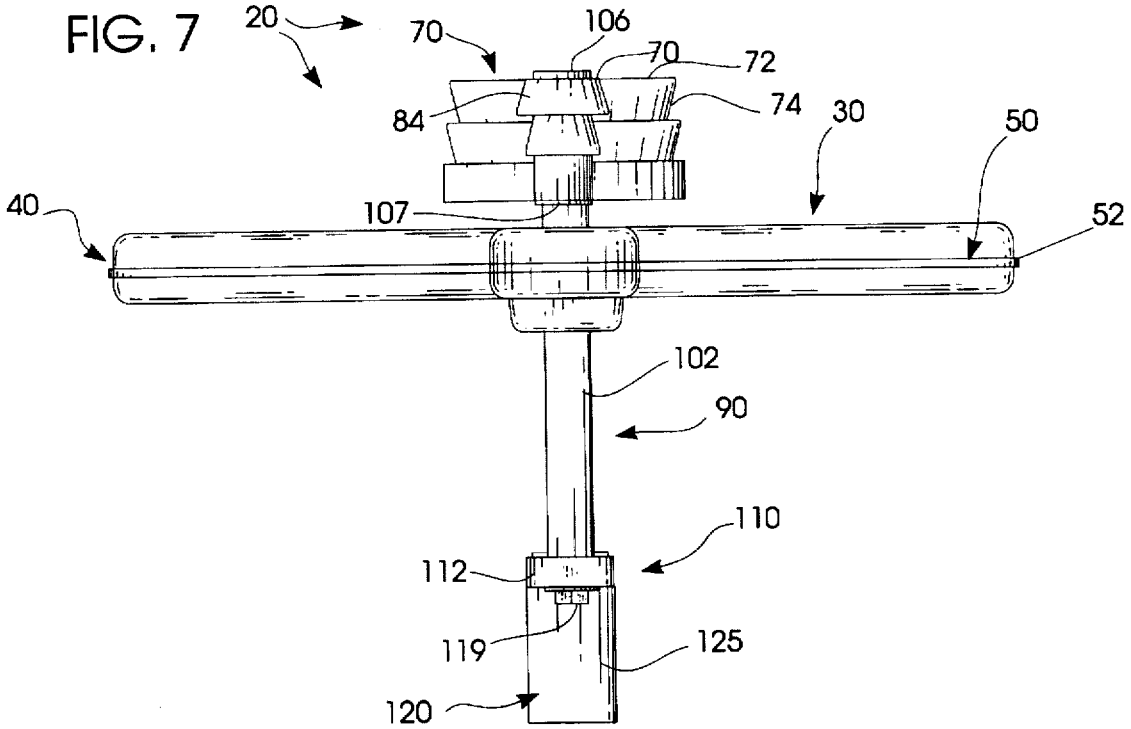
FIG. 7 is a bottom plan view.

Guide channel 40 is employed by the operator to efficiently maintain proper alignment of sheet 24 during use. Each opposite, exterior end of guide channel 40 comprises a longitudinally displaced access throat 41 or 42. Throats 41 and 42 expedite initial sheet entry and exit from guide 40. Note that the throat input edges 53A and 53B (FIGS. 2,3), comprising ends of the frame base 31, are offset to easily clear and receive the leading edge of the metal sheet when first inserted.

Figure 8:
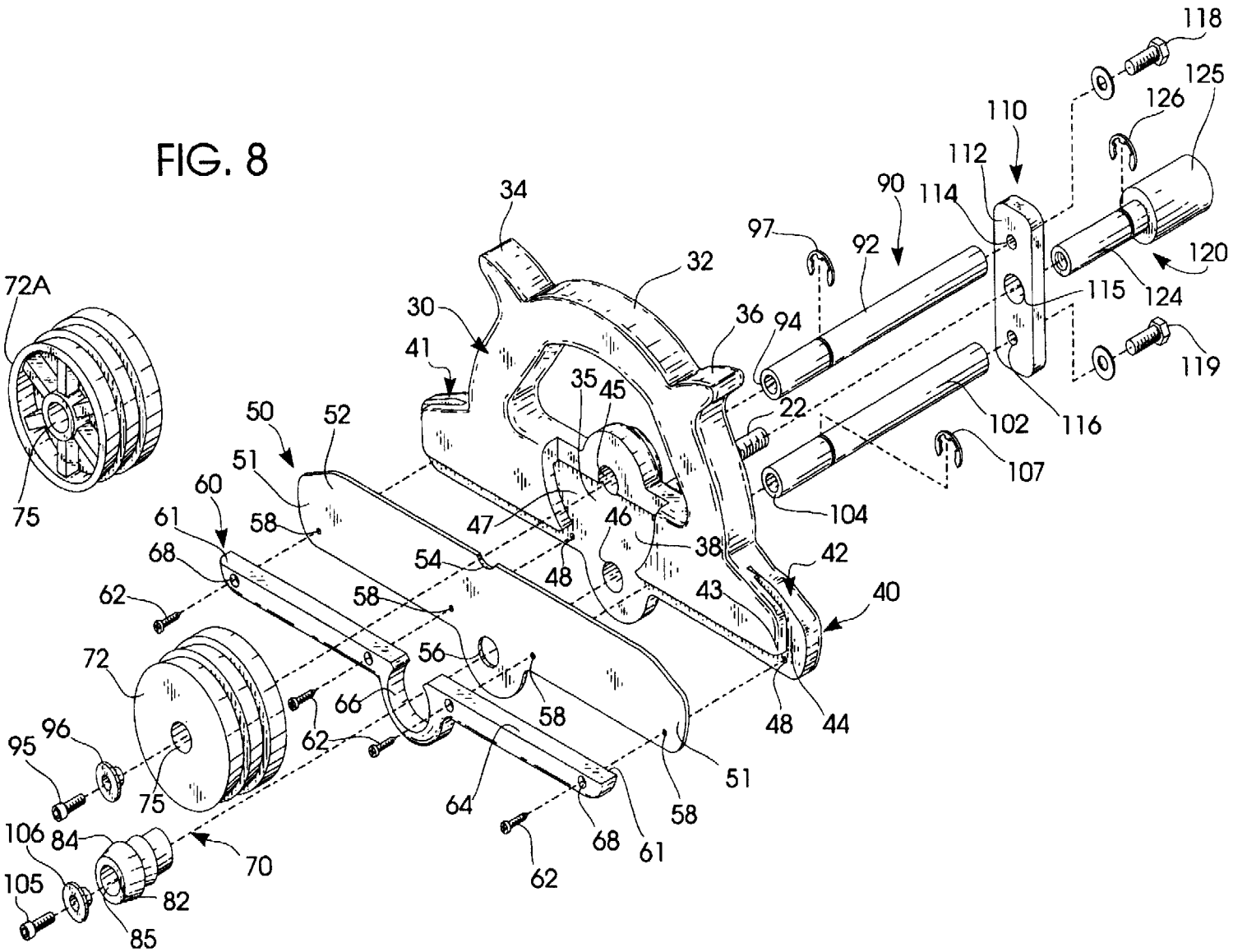
FIG. 8 is an exploded isometric view with an alternative roller wheel exploded in position away from the preferred roller wheel.

Guide channel 40 is split into a vertically oriented guide slot 44 and a horizontally oriented guide slot 43. Each exterior end of guide slot 43 has a terminal entry facilitating upturned wedge 48 and a reentry upturned wedge 49. The lower frame half is also penetrated by two holes 45, 46 for axle mounting, as is discussed more fully later (FIG. 8). A substantially interior planar base 47 encompasses recess 38 and while also providing a mounting surface for a non-abrasive liner 50 and keeper 60.

Liner 50 comprises a flat, planar body 52 with protruding edges 51. Liner 50 prevents sheet marring when tool 20 is moved along sheet 24. Preferably, liner 50 is manufactured from a lubricant coated plastic. Consequently, as body 52 is rubbed by sheet 24 during tool movement, lubricants are released to prevent sheet abrasion. The upper periphery of body 52 defines an indentation 54 to accommodate the upper axle while the interior defines a hole 56 for the lower axle, as is discussed in more detail hereinafter.

An elongated keeper 60 secures the liner 50 to frame 30. Liner 50 and keeper 60 are both penetrated by several screws 62 via holes 68, 58 and 48 to secure liner 50 and keeper 60 to frame 30. Of course, other conventional attachment devices could be utilized to secure the keeper and liner. Keeper 60 also provides a convenient upper surface 64 that facilitates sheet movement along its upper edge. Keeper surface 64 also defines the lower border of slot 43. As such, keeper 60 is preferably also formed of self-lubricating plastic like liner 50. A large indentation 66 facilitates uninterrupted lower roller movement, as is also discussed hereinafter. Keeper edges 61 also protrude from guide channel 40 like liner edge 51.

Figure 11:
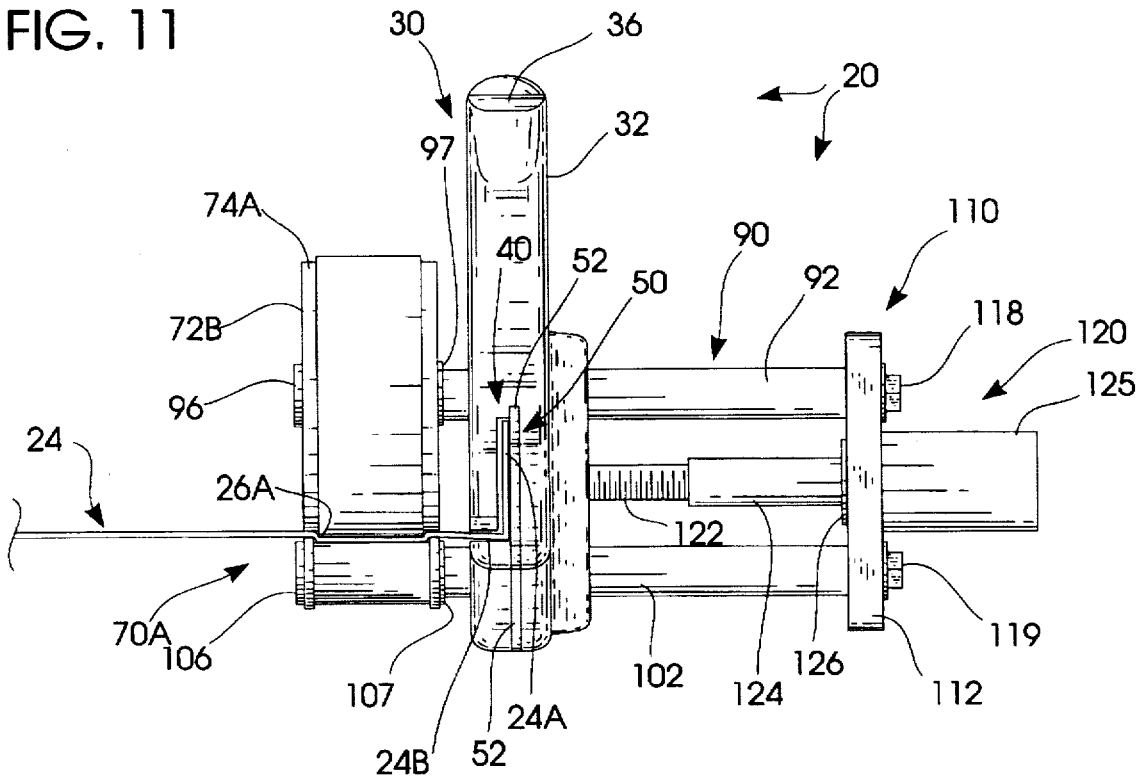

The sheet 24 is physically deformed by a press roller set 70. The roller set 70 comprises an upper roller 72 and a lower roller 82. An alternative roller 72A is shown in FIGS. 2A and 8. Preferably, the rollers are hard plastic so that they do not mar the sheet 24. The roller set 70 is variably offset from the frame as explained below. Both rollers define mating circumferential deforming patterns 74, 84. An alternative pattern 74A is shown in FIG. 11. Patterns 74 and 84 cooperate during sheet deformation to bend the sheet 24 about the respective pattern edges to form pressure bends 26. Each roller 72, 82 comprises a central hub 75, 85 about which it rotates.

Roller set 70 is rotatably mounted on axle set 90. Axle set 90 comprises an elongated upper axle 92 and a parallel, spaced apart elongated lower axle 102. Upper axle 92 supports upper roller 72 and lower axle 102 supports lower roller 82.

Each axle 92, 102 has a terminal end 94, 104 that penetrates frame holes 45 and 46 (and holes 56 and indentation 66) respectively to protrude outwardly from frame 30. Thus, each axle 92, 102 slidably penetrates the frame 30. Preferably, ends 94 and 104 are threaded to receive roller nuts 95 and 105 to secure rollers 72 and 82. A pair of washers 96, 106 may be used to ensure even pressure on rollers 72, 82. A conventional snap ring 97, 107 secures the rear of each roller 72, 82 and also prevents axles 92, 102 from moving through holes 45 and 46. Therefore, roller set 70 quick couples to axle set 90 to simplify removal whenever the operator desires to switch rollers to alter the resultant deformation pattern (as shown in FIG. 11). The distal ends 99, 109 of axles 92, 102 are anchored by a subframe 110.

Figure 10:
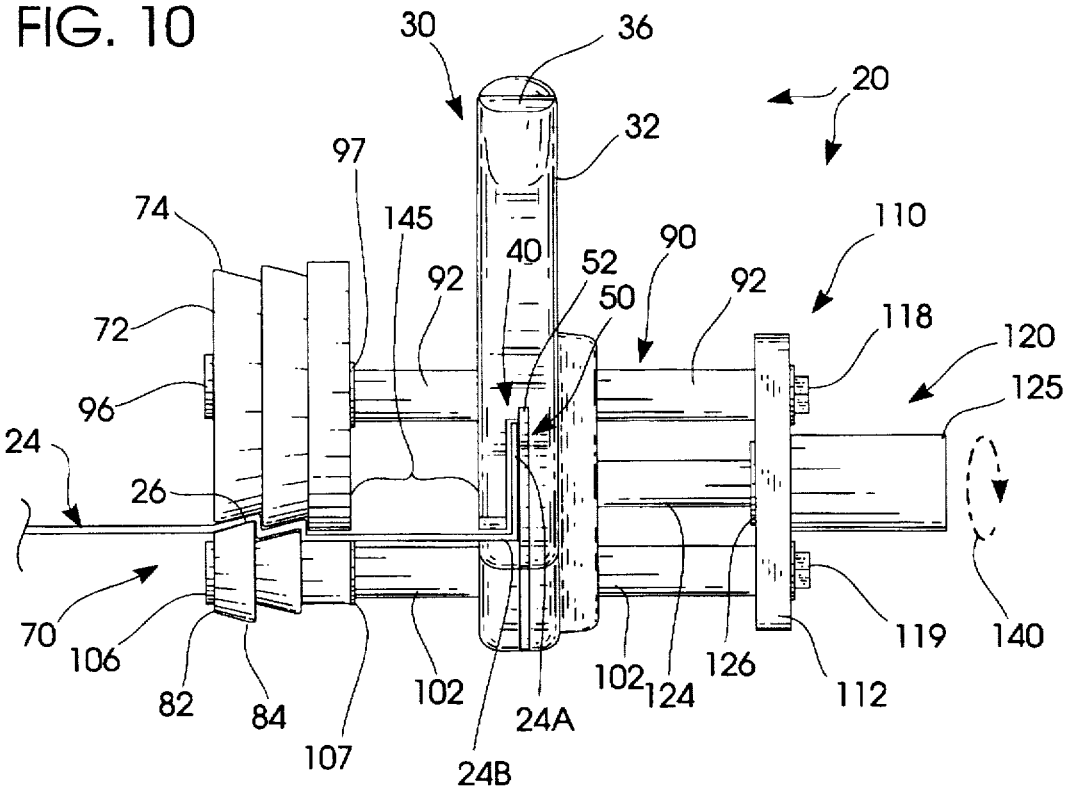
FIG. 10 is a side elevational view similar to FIG. 9 but showing the rollers in a moved location; and, FIG. 11 is a side elevational view similar to FIG. 9 but showing alternative rollers.

Subframe 110 is adjustably spaced apart from the frame 30. In other words, the subframe spacing 112 from the frame may be selectively adjusted to accommodate various operational parameters (FIGS. 9–10). Subframe 110 comprises a flat plate 112 that anchors axle ends 99 and 109. Plate 112 is penetrated by three holes 114, 115 and 116. Hole 114 permits axle bolt and associated washer 118 to anchor distal axle end 99. Hole 116 permits axle bolt and associated washer 119 to anchor distal axle end 109. Hole 115 supports the sliding adjustment system 120.

Adjustment system 120 comprises an elongated, threaded shaft 122 protruding outwardly from frame 30. An interiorly threaded sleeve 124 mates to shaft 122. A knurled adjustment knob 125 is splined to sleeve 124. Turning the knob 125 facilitates operator adjustments of the rollers by manipulation of system 120. As knob 125 is rotated, system 120 selectively moves towards or away from frame 30. A conventional snap ring 126 axially retains sleeve 124, preventing it from moving through hole 115.

OPERATION

During use, the operator 22 simply grasps the handle 32 and aligns the tool 20 on a sheet of siding. As the tool 20 is aligned, the offset throats 41 or 42 facilitate sheet entry by permitting the operator to first place sheet edge 23 against exposed liner edge 51 and keeper edge 61. Then the operator simply pushes tool 20 along the siding sheet 24 or the like to selectively bend it (FIG. 1). When so pushed, the tool enters throat 41 or 42, forcing roller set 70 to rotate and move along the siding surface while pressing against it. The upper roller 72 supports tool 20 while pressing downwardly upon the sheet 24 and the lower roller 82 presses upwardly. This joint interaction forces the sheet to bend into desirable reinforcing pressure bends 26.

As the tool 20 moves over the sheet 24, the conventional upturned siding edge 24A slides along the guide 40 to maintain the siding alignment with respect to the roller set 70. Edge 24A enters slot 44 while edge 24B concurrently enters slot 43 via wedge 48. As edges 24A, 24B approach midpoint 35, they momentarily leave slots 43 and 44. As edges 24A, 24B pass midpoint 25, they reenter slots 43 and 44. Wedge 48 forces edge 24A to reenter slot 43.

To accommodate varying operational parameters, the tool 20 can be adjusted to place bends 26 in different locales on sheet 24. In other words, the pressure bends 26 can be closer to edge 24A or farther away as necessary. Adjustment system 120 permits the operator to select the ridge location. When knob 125 is turned clockwise (as indicated by arrow 130), the offset (as indicated by arrow 135) between subframe 120 and frame 30 decreases (the rollers may actually abut frame 25 via recess 38). Alternatively, when knob 125 is turned counterclockwise (as indicated by arrow 140), the offset (indicated by arrow 140) increases, preferably to as much as three inches. As the offset changes, the roller set 70 moves counter to the subframe movement. In other words, when the subframe 110 moves toward the frame 30, the roller set 70 moves away from frame 30 and vice-versa.

Of course, the pressure bends 26 can take a variety of shapes. In FIG. 11, an alternative roller set 70A has been used to form a different ridge pattern. All the operator need do to change rollers is to uncouple one set 70 and replace it with another set 70A.

The tool 20 may be used with or without a conventional brake (brake not shown). When used with a brake, the sheet 24 is simply inserted into the brake in the normal fashion and then the tool 20 moves over the clamped sheet. When used without a brake, the sheet 24 may be otherwise supported as the tool 20 moves over the sheet. Other support devices commonly found at construction sites include edges of floors, truck beds, saw horses, etc. After deforming, the sheet or siding may then be quickly installed in the usual manner.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable hand tool for forming or beading sheeting, said tool comprising:

a rigid frame;

handle means for enabling tool manipulation;

guide channel means longitudinally coextensive with said frame for admitting and captivating sheeting to be formed;

variably offset press roller means for forming said sheeting;

said guide channel means comprising an elongated horizontal guide slot defined in said frame for receiving and orienting a horizontal portion of sheet material and an elongated vertical guide slot defined in said frame for receiving and captivating an upturned edge of sheet material to maintain spacing as the press roller means moves;

wherein said vertical guide slot and said horizontal guide slot are bifurcated at an approximate center of said frame substantially adjacent said roller means; and, subframe means for controlling said press roller means.

2. The tool as defined in claim 1 wherein each side of the bifurcation point comprises an angled wedge for admitting sheet into the adjacent horizontal guide slot.

3. The tool as defined in claim 1 wherein said subframe means comprises:

a pair of parallel, spaced apart axles slidably extending through said frame to support said roller means;

a rigid plate for anchoring said axles, said plate spaced from said frame at a user selected offset; and, adjustment means secured to said plate for varying said offset.

4. The tool as defined in claim 2 wherein said guide channel means terminates at each end of said frame in an offset admission throat.

5. The tool as defined in claim 2 wherein pressure bearing surfaces of said guide channel means are resiliently lined to prevent sheet marring.

6. A portable hand tool for forming or beading sheeting, said tool comprising:

a rigid frame;

ambidextrous handle means associated with said frame for facilitating operator manipulation of said tool;

guide channel means longitudinally coextensive with said frame for admitting and captivating sheeting to be formed, said guide channel means terminating at each end of said frame in an offset admission throat;

a pair of complimentary press rollers offset from said frame for forming sheeting sandwiched therebetween; and, subframe means for controlling said press rollers, said subframe means comprising a pair of parallel, spaced apart axles slidably extending through said frame to support said rollers and adjustment means for varying the offset of said press rollers from said frame, said subframe means further comprising a rigid plate for anchoring said axles that is spaced from said frame at a user selected offset; and, wherein said adjustment means for varying said offset comprises means rotatably captivated by said plate and threadably mated to a shaft protecting from said frame.

7. The tool as defined in claim 6 wherein said guide channel means comprises an elongated vertical guide slot defined in said frame for receiving and captivating an upturned edge of sheet material to maintain spacing from said press rollers and an elongated horizontal guide slot defined in said frame for receiving and orienting a horizontal portion of sheet material as the press rollers deform material.

8. The tool as defined in claim 7 wherein said frame has a midpoint and said horizontal guide slot is bifurcated into two separate, space apart and aligned portions adjacent the frame midpoint, and each side of the bifurcation point comprises an angled wedge for forcing sheet admission into the adjacent horizontal guide slot.

9. The tool as defined in claim 8 wherein said frame further comprises a recess located near the frame midpoint that is adapted to receive at least a portion of said press rollers to facilitate adjustment thereof.

10. The tool as defined in claim 9 wherein the guide channel means comprises pressure bearing surfaces that are resiliently lined to prevent sheet marring.

11. A portable hand tool for forming or beading sheeting, said tool comprising:

a rigid frame having a midpoint;

ambidextrous handle means associated with said frame for facilitating operator manipulation of said tool;

guide channel means longitudinally coextensive with said frame for admitting and captivating sheeting to be formed, said guide channel means terminating at each end of said frame in an offset admission throat and comprising an elongated vertical guide slot defined in said frame for receiving and captivating an upturned edge of sheet material to maintain spacing and an elongated horizontal guide slot defined in said frame for receiving and orienting a horizontal portion of sheet material as the tool deforms material;

a pair of press rollers offset from said frame for forming sheeting sandwiched therebetween; and, subframe means for controlling said press rollers, said subframe means comprising a pair of parallel, spaced apart axles slidably extending through said frame to support said rollers and a rigid plate for anchoring said axles, said plate spaced from said frame at a user selected offset, and an adjustment means for varying the offset of said subframe from said frame to control roller offset, said adjustment means comprising knob means rotatably captivated by said plate and threadably mated to a threaded shaft projecting from said frame; and, wherein said horizontal guide slot is bifurcated into two separate, spaced apart and aligned portions adjacent the frame midpoint, and each side of the bifurcation point comprises an angled wedge for easing sheet admission into the adjacent horizontal guide slot.

* * * * *